US006889857B2

(12) United States Patent
Francois et al.

(10) Patent No.: US 6,889,857 B2
(45) Date of Patent: May 10, 2005

(54) SEALING ARRANGEMENT FOR A CLOSURE FOR A FITMENT

(75) Inventors: James A. Francois, Evansville, IN (US); William J. Shankland, Evansville, IN (US); Chris W. Winstead, Evansville, IN (US); C. Edward Luker, Evansville, IN (US)

(73) Assignee: Rexam Medical Packaging Inc., Evansville, IN (US)

( * ) Notice: Subject to any disclaimer, the term of this patent is extended or adjusted under 35 U.S.C. 154(b) by 26 days.

(21) Appl. No.: 10/061,654

(22) Filed: Feb. 1, 2002

(65) Prior Publication Data

US 2003/0146185 A1 Aug. 7, 2003

(51) Int. Cl.[7] ..... B65D 53/00
(52) U.S. Cl. ..... 215/344; 215/232
(58) Field of Search ..... 215/232, DIG. 1, 215/341–345, 346, 234, 352, 354

(56) References Cited

U.S. PATENT DOCUMENTS

| | | | | |
|---|---|---|---|---|
| 3,074,579 A | | 1/1963 | Miller | |
| 3,118,578 A | | 1/1964 | Collins | |
| 3,223,269 A | | 12/1965 | Williams | |
| 4,289,248 A | | 9/1981 | Lynn | |
| 4,387,822 A | | 6/1983 | Lynn | |
| 4,442,947 A | | 4/1984 | Banich, Sr. | |
| 4,545,499 A | * | 10/1985 | Bennett et al. | 215/352 |
| 4,640,430 A | | 2/1987 | Haines | |
| 4,697,716 A | | 10/1987 | Mumford | |
| 4,770,308 A | | 9/1988 | Lynn | |
| 4,781,311 A | | 11/1988 | Dunning et al. | |
| 5,096,083 A | | 3/1992 | Shaw et al. | |
| 5,100,009 A | | 3/1992 | Thompson et al. | |
| 5,100,013 A | * | 3/1992 | Strassheimer | 215/354 |
| 5,133,471 A | | 7/1992 | Pujol Almirall | |
| 5,145,080 A | | 9/1992 | Imbery, Jr. | |
| 5,169,033 A | | 12/1992 | Shay | |
| 5,275,287 A | * | 1/1994 | Thompson | 215/344 |
| 5,462,186 A | | 10/1995 | Ladina et al. | |
| 5,549,213 A | | 8/1996 | Robbins, III et al. | |
| 5,593,055 A | | 1/1997 | Repp et al. | |
| 5,622,865 A | | 4/1997 | Kayal et al. | |
| 5,630,522 A | | 5/1997 | Montgomery | |
| 5,673,809 A | * | 10/1997 | Ohmi et al. | 215/252 |
| 5,676,270 A | | 10/1997 | Roberts | |
| 5,803,286 A | * | 9/1998 | Pfefferkorn et al. | 215/307 |
| 5,871,111 A | | 2/1999 | Pfefferkorn et al. | |
| 5,915,574 A | | 6/1999 | Adams et al. | |
| 5,915,579 A | | 6/1999 | Przytulla et al. | |
| 6,041,953 A | | 3/2000 | Goodall | |
| 6,123,212 A | | 9/2000 | Russell et al. | |
| 6,126,027 A | | 10/2000 | Thompson | |
| 6,241,111 B1 | | 6/2001 | Sandor et al. | |
| 6,338,414 B1 | * | 1/2002 | Schellenbach | 215/252 |
| 6,491,175 B1 | * | 12/2002 | Taha | 215/252 |
| 6,502,710 B1 | * | 1/2003 | Bösl et al. | 215/351 |
| 6,679,359 B2 | * | 1/2004 | Pfeiffer | 190/107 |
| 6,695,161 B2 | * | 2/2004 | Kano et al. | 215/341 |
| 2001/0002012 A1 | | 5/2001 | Yeaton et al. | |
| 2001/0027957 A1 | * | 10/2001 | Kano | |
| 2002/0158037 A1 | * | 10/2002 | Kano et al. | |

FOREIGN PATENT DOCUMENTS

| | | | | |
|---|---|---|---|---|
| GB | 2133394 | * | 7/1984 | 215/252 |

* cited by examiner

*Primary Examiner*—Lien M. Ngo
(74) *Attorney, Agent, or Firm*—Charles G. Lamb; John F. Salazar; Middleton Routlinger

(57) ABSTRACT

A closure for a fitment is provided with an outer side wall extending downwardly therefrom and spaced from an inner sealing ring wherein the outer side wall adjacent the top wall is provided with a plurality of spaced inwardly extending ribs, adapted for embedding into a lip at the outlet of a fitment neck.

10 Claims, 2 Drawing Sheets

FIG. 1
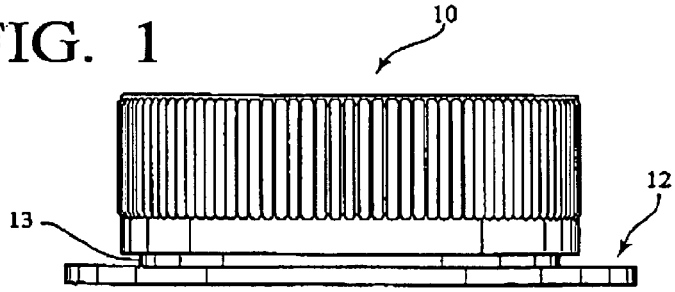
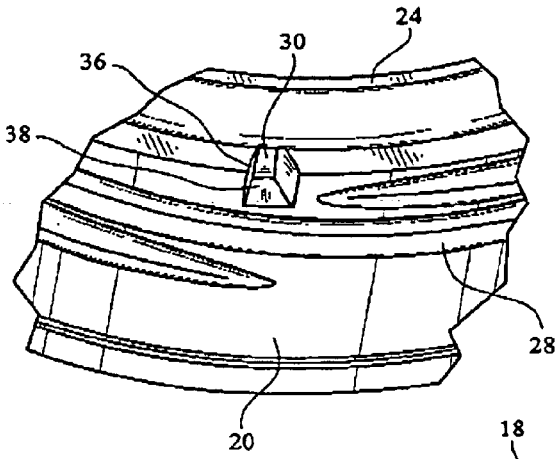
FIG. 4
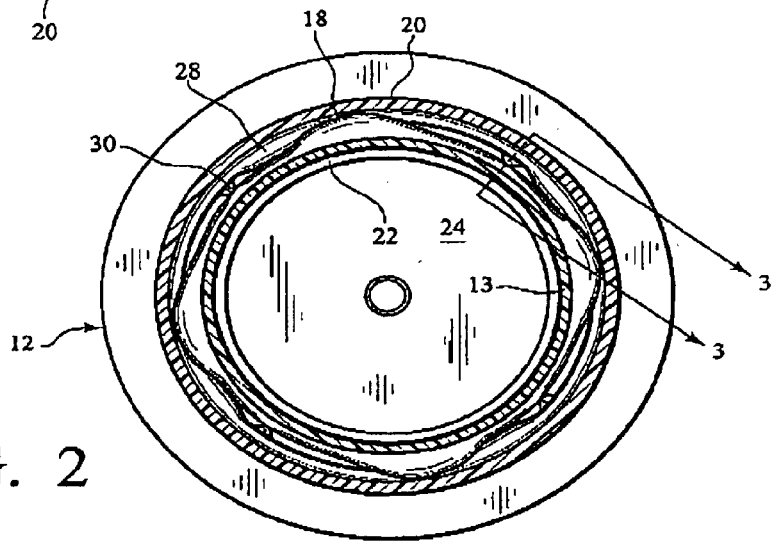
FIG. 2

SEALING ARRANGEMENT FOR A CLOSURE FOR A FITMENT

BACKGROUND OF THE INVENTION

The present invention relates to an improved sealing arrangement of a closure with a container and more particularly to an improved sealing arrangement for a closure having an inner sealing ring engagable in sealing relation with the inner surface of the neck of a container or fitment.

In the manufacture of containers having dispensing fitments or spouts attached to the tops thereof, it is common to utilize a closure for these fitments which include an inner sealing ring spaced from an outer downwardly depending skirt of the closure with a neck wall of the dispensing fitment being sandwiched between the inner sealing ring and the outer skirt of the closure when in a closed condition. For relatively small closures, such as those that are used for gable top cartons of milk, orange juice and other liquids, the closures and the fitments are generally made of relatively flexible plastic material. And, it is common in the manufacture of these closures and fitments for the manufacturer to utilize too much torque in the initial fitting of the closure to the fitment, thereby damaging the dispensing fitment. Too much torque chews up the fitment on the bottom and the broken pieces of fitment may fall into the container when the fitment is initially placed onto the container. Furthermore, it has been found that with prior art closures, when a closure gets hit with a blow that results in a slight unscrewing of the closure, the resistance of the plug or inner sealing ring on the inner surface of the neck of the closure or fitment is not sufficient to keep it from unscrewing.

SUMMARY OF THE INVENTION

It is an object of the present invention to provide a closure for a threaded fitment having an inner sealing ring which engages with the inner surface of a fitment neck wall with an improved seal between the closure and the fitment.

It is another object of the present invention to provide a closure having a top wall with an outer skirt or side wall and an inner sealing ring spaced inwardly from the outer skirt, the skirt and sealing ring extending downwardly wherein an inner surface of the skirt includes a plurality of vertically extending ribs circumscribing an upper portion of the skirt adjacent the top wall for embedding into a neck wall or lip of a container or fitment when the closure is screwed down onto the container or fitment.

It is a further object of the present invention to provide a closure with ribs or flats circumferentially spaced along a downwardly extending skirt adjacent an inside top wall of the closure with a spaced inner ring seal to provide added support to a fitment lip.

It is also an object of the present invention to provide a closure having vertically extending ribs along an upper inner surface of an outer side wall of a relatively hard plastic material for engagement with a fitment which is made of a softer plastic material so that when the ribs embed into the fitment, this provides sufficient drag torque to prevent the closure from unscrewing in sorting and handling equipment.

More particularly, the present invention provides a closure for a fitment for a container or a container neck which includes a top wall with an outer side wall extending downwardly therefrom with an inner sealing ring spaced inwardly from the side wall. The outer side wall is provided with vertically extending ribs spaced circumferentially around the upper inner surface of the side wall for engagement with a fitment lip as the closure is moved downwardly onto the fitment. Preferably, the vertically extending ribs have an outer edge which is angled downwardly in a direction toward an inner surface of the downwardly extending side wall. Moreover, the inner sealing ring is preferably provided with a lower beveled terminating edge engagable with the fitment neck and the spacing between the upper portion of the rib and an upper portion of an outer surface of the sealing ring is less than the thickness of the fitment neck so that as the closure is moved down onto the fitment neck, the ribs embed into the lip of the fitment neck.

All of the above outlined objectives are to be understood as exemplary only and many more objectives of the invention may be gleaned from the disclosure herein. Therefore, no limiting interpretation of the objectives noted is to be understood without further reading of the entire specification, claims, and drawings included herewith. Various other feature of the present invention will become obvious to one skilled in the art upon reading the disclosure set forth herein.

BRIEF DESCRIPTION OF THE DRAWINGS

FIG. 1 is a side view of a preferred closure of the present invention with a fitment for a container;

FIG. 2 is a bottom plan view of the closure and fitment of FIG. 1;

FIG. 4 is an enlarged fragmentary sectional perspective view showing details of selected portions of the closure of the present invention; and, FIG. 5 is fragmentary bottom plan view of another preferred closure of the present invention.

DETAILED DESCRIPTION OF THE PREFERRED EMBODIMENT

Figure 3:
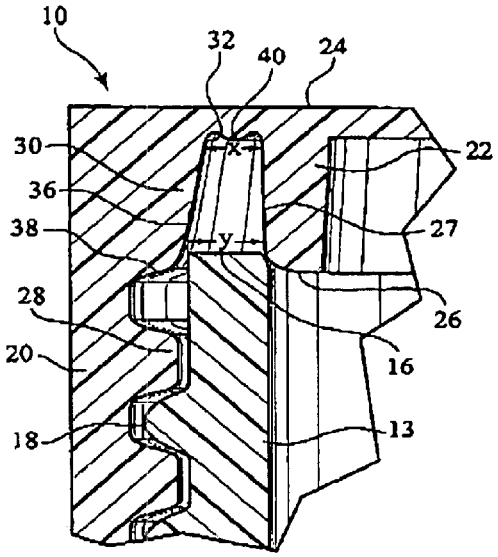
FIG. 3 is an enlarged fragmentary sectional view taken along line 3—3 of FIG. 2.

FIG. 1 shows a plastic cap or closure 10 of the present invention screwed onto a neck 13 of a fitment 12 which is generally attached to a container for liquids, such as a container for soft drinks, juices, or the like. Generally the closure 10 is made of a harder plastic material than the fitment 12. Examples of plastic materials used for the closures 10 include, but are not limited to polypropylene whereas examples of plastic materials used for the fitments 12, include but are not limited to polyethylene. Moreover, the terms fitment and containers and container necks are used interchangeable throughout this application.

As shown in FIGS. 2–4, the closure 10 is provided with a top wall 24 and a downwardly extending outer side wall 20 with an inner sealing ring 22 spaced inwardly from the outer side wall 20. The outer side wall 20 is generally provided with threads 28 for mating with threads 18 on the fitment neck 13.

Spaced circumferentially along the upper inner surface of the outer side wall 20 is a plurality of vertically extending ribs 30. Each rib 30 is provided with an inner edge 36 which is angled downwardly toward the inner surface of the side wall 20 terminating with a lower terminating edge 32. Thus, as best shown in FIG. 3, when the closure 10 is placed upon the fitment neck 13, the spacing between the rib 30 and the sealing ring 22 is greater than the thickness, as identified at "y", of the fitment neck 13. Moreover, as shown in FIG. 3, the upper portion 32 of the rib 30 is spaced from the sealing ring 22 by a distance "x" which is less than the thickness "y" of the fitment neck 13.

Figure 3A:
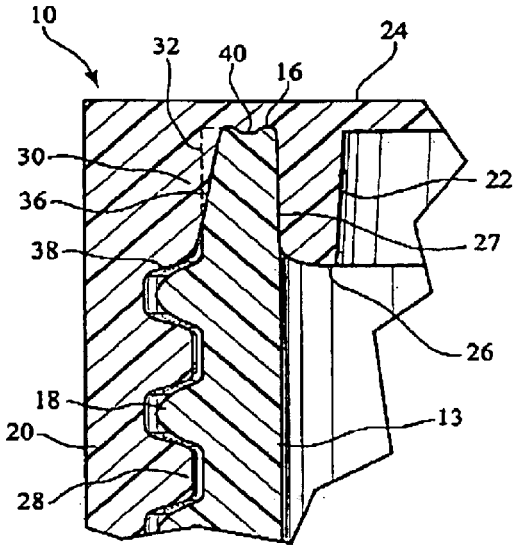
FIG. 3A is the sectional view of FIG. 3 showing the closure in a closed condition on a fitment.

The sealing ring 22 is provided with a lower terminating edge 26 which is shown as a beveled edge for ease of engagement with the lip 16 of the fitment neck 13. As shown in FIG. 3A, as the closure 10 is rotated and threaded downwardly onto the fitment neck 13, the lip 16 is caught between the ribs 30 and the outer surface 27 of the sealing ring 22. Preferably, the closure 10 is made of a harder plastic material than the fitment 12 and as the closure is threadably received by the fitment neck 13, the sealing ring 22 forces the lip 16 into the upper portion 32 of the ribs 30. With the ribs 30 embedded into the fitment neck 13 at the lip 16, this provides additional drag torque to prevent the closure 10 from unscrewing by sorting and handling equipment (not shown).

Also, as shown in FIGS. 3 and 3A, top wall 24 is provided with a circumferential flange or second seal 40 on an inner surface thereof and spaced between outer wall 18 and sealing ring 22. Second seal 40, as best shown in FIG. 3A, embeds into lip 16 when closure 10 is in a closed condition.

Figure 5:
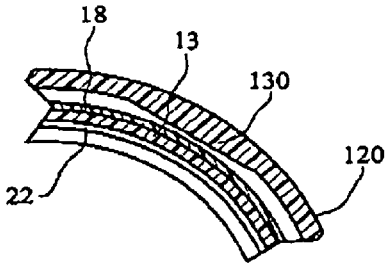

As shown in FIG. 5, the ribs 30 have been modified. In this embodiment the closure 10 is provided with an outer side wall 120 having a plurality of inwardly extending flat portions 130 instead of the distinctive rib sections 30. The flats 130 are of generally the same angled downwardly extending configuration of the ribs 30 and are also provided with lower terminating edges (not shown) similar to the lower terminating edges 38 of ribs 30.

It is to be understood that various changes can be made by one skilled in the art to the preferred embodiments discussed herein without departing from the scope or spirit of the present invention as set forth in the appended claims.

What is claimed is:

1. A closure in combination with a fitment for a container comprising:

said fitment having a fitment neck;

said closure having a top wall with an outer side wall extending downwardly therefrom and an inner sealing ring spaced inwardly from said side wall, the outer side wall having circumferentially spaced vertically extending ribs along an upper inner surface adjacent said top wall, the inner sealing ring having a lower terminating edge engagable with a lip of a fitment neck inner surface, the spacing between an upper portion of said ribs and an upper portion of an outer surface of said sealing ring being less than the thickness of said fitment neck, said vertically extending ribs contacting said fitment neck at the spaced locations of said circumferentially spaced ribs embedding into said fitment neck and preventing said closure from inadvertently unthreading from said fitment.

2. The combination of claim 1, the spacing between lower terminating edges of said outer edges of said ribs and said outer surface of said sealing ring being greater than the thickness of said fitment neck.

3. The combination of claim 1, said lower terminating edge of said sealing ring being beveled.

4. The combination of claim 1, said top wall having a downwardly extending flanged portion spaced between said upper portion of said rib and said outer surface of said inner sealing ring.

5. The combination of claim 1, said closure having at least one thread disposed circumferentially along an inner surface of said outer wall.

6. The combination of claim 1, said fitment being unitary with said container.

7. The combination of claim 1, said closure and said fitment being made of plastic materials, said closure being of a harder plastic material than said fitment.

8. A closure and container combination, comprising:

a container neck extending upward and having at least one thread formed thereon;

said closure threadably engaging said container neck, said closure having a top wall, a depending annular outer side wall and a depending annular seal, said side well having at least one thread thereon and a spaced from said depending annular seal, said closure also having a defined area about the joinder of said side wail and said lop wall, said defined area populated with a plurality of abutments thereby forming a decreased width between said plurality of abutments and said annular seal wherein said decreased width is less than the thickness of said container neck, said decreased width causing said neck to contact said closure top wall and said plurality of abutments to embed into said container neck due to said closure being constructed of a material harder than said container neck.

9. A closure for a fitment, comprising:

said fitment having an upstanding neck and at least one thread formed thereon;

said closure having a top wall and a depending annular side wall with at least one thread on an interior surface thereof, a plurality of ribs formed along an interior area defined by the joining of said side wall and said top wall, said ribs being substantially vertically extending with outer edges downwardly in a direction towards an inner surface of said annular side wall, said closure further having a seal depending from said top wall and spaced interiorly from said plurality of ribs;

wherein said ribs cause a top portion of said upstanding neck to be compressed between said ribs and said seal by embedding into said fitment neck when said closure is fully threaded onto said fitment.

10. A closure and fitment combination, comprising:

a fitment having an upstanding fitment neck with at least one helical thread;

a closure threadably engageable with said fitment neck and having a top wall and depending annular side wall, a depending annular seal extending downward from said top wall, a plurality of vertical ribs extending inward from said side wall near said top wall, said plurality of vertical ribs and said depending annular seal forming a predefined width, said predefined width smaller than the thickness of said upstanding fitment neck, said fitment neck having a lip which contacts said top wall of said closure upon application of said closure to said fitment neck, said plurality of vertical ribs extending inward to engage said fitment neck and embed into said neck to prevent accidental unthreading of said closure from said fitment.

* * * * *